US008582999B2

(12) United States Patent
Tada et al.

(10) Patent No.: US 8,582,999 B2
(45) Date of Patent: Nov. 12, 2013

(54) PROCESS CARTRIDGE AND ELECTROPHOTOGRAPHIC APPARATUS HAVING ELECTRICAL CONNECTION

(75) Inventors: Kaoru Tada, Osaka (JP); Toru Hanashima, Hyogo (JP); Kazuyoshi Kondo, Osaka (JP); Kimihiro Tanaka, Osaka (JP); Kenji Nakamura, Osaka (JP); Yuuki Shiga, Hyogo (JP); Yuusuke Furuichi, Osaka (JP); Ryouhei Ohi, Kyoto (JP)

(73) Assignee: Ricoh Company, Limited, Tokyo (JP)

( * ) Notice: Subject to any disclaimer, the term of this patent is extended or adjusted under 35 U.S.C. 154(b) by 308 days.

(21) Appl. No.: 13/064,214

(22) Filed: Mar. 11, 2011

(65) Prior Publication Data

US 2011/0229197 A1 Sep. 22, 2011

(30) Foreign Application Priority Data

Mar. 18, 2010 (JP) ..... 2010-062756

(51) Int. Cl.
*G03G 15/00* (2006.01)
*G03G 21/18* (2006.01)

(52) U.S. Cl.
USPC ..... 399/90; 399/113

(58) Field of Classification Search
USPC ..... 399/12, 13, 88, 90, 111, 113
See application file for complete search history.

(56) References Cited

U.S. PATENT DOCUMENTS

| | | | | |
|---|---|---|---|---|
| 5,521,693 | A | 5/1996 | Kojima et al. | |
| 7,302,201 | B2 * | 11/2007 | Park | 399/90 |
| 7,512,363 | B2 * | 3/2009 | Kamimura | 399/119 |
| 7,787,797 | B2 * | 8/2010 | Sato | 399/90 |
| 8,233,816 | B2 * | 7/2012 | Ishii et al. | 399/90 |
| 2008/0063425 | A1 | 3/2008 | Idehara et al. | |
| 2008/0292356 | A1 | 11/2008 | Furuichi et al. | |

FOREIGN PATENT DOCUMENTS

| | | | |
|---|---|---|---|
| JP | 06118736 | A | 4/1994 |
| JP | 06118736 | A * | 4/1994 |
| JP | 09185236 | A | 7/1997 |
| JP | 10240068 | A * | 9/1998 |
| JP | 3132073 | B | 11/2000 |
| JP | 2006145765 | A | 6/2006 |
| JP | 2006-337401 | | 12/2006 |
| JP | 2007114718 | A | 5/2007 |
| JP | 2008276273 | A | 11/2008 |

OTHER PUBLICATIONS

Abstract of Japanese Patent Publication No. JP05-061393, published on Mar. 12, 1993.

Chinese Office Action dated Aug. 3, 2012, issued in corresponding Chinese Patent Application No. 201110065358.9.

* cited by examiner

*Primary Examiner* — Robert Beatty
(74) *Attorney, Agent, or Firm* — Harness, Dickey & Pierce P.L.C.

(57) ABSTRACT

A process cartridge includes an image carrier unit which is equipped with an image carrier, on which an electrostatic latent image is formed, and a developer supply unit which supplies developer to the image carrier unit 11. The image carrier unit and the developer supply unit are configured to be attached and detached with respect to an apparatus main body in which the units are accommodated. Electrical contacts are provided to form electrical connection between the image carrier unit 11 and the developer supply unit 9 in a mounted state in the apparatus main body.

6 Claims, 7 Drawing Sheets

PROCESS CARTRIDGE AND ELECTROPHOTOGRAPHIC APPARATUS HAVING ELECTRICAL CONNECTION

CROSS-REFERENCE TO RELATED APPLICATIONS

The present application claims priority to and incorporates by reference the entire contents of Japanese Patent Application No. 2010-062756 filed in Japan on Mar. 18, 2010.

BACKGROUND OF THE INVENTION

1. Field of the Invention

The present invention relates to an image forming apparatus, such as an electrophotographic multi-function peripheral (MFP), facsimile, or printer, and in particular, to an electrophotographic apparatus having a user-replaceable unit.

2. Description of the Related Art

In an electrophotographic image forming apparatus, such as a printer, a facsimile, or a MFP having function of a printer and a facsimile, for example, a photosensitive element and a cleaner or a developing unit around the photosensitive drum are unitized as a single unit, and the unit is configured to be freely replaced with respect to the main body of the image forming apparatus (apparatus main body). This unit is consumables and should be replaced when the lifetime has come to an end or the like. In this case, an image carrier unit equipped with a photosensitive drum should have a toner supply unit in order to be supplied with toner as developer.

In an image forming apparatus, the density or the like of an image to be formed is affected by the environmental conditions, such as temperature and humidity, the history conditions, such as a residual toner amount, or the like. Thus, in the image carrier unit, it is necessary that the residual toner amount at the toner supply unit which supplies toner should be detected.

In the related art, an electrophotographic apparatus is known in which ease and simplification of determination on whether a unit (a replaceable unit with respect to an apparatus main body) is new or old are achieved, thereby increasing lifetime management accuracy of the unit (Japanese Unexamined Patent Application Publication No. 6-118736). In this apparatus, an electronic element which is configured to be destroyed through energization from the apparatus main body is arranged in the unit, and the determination on whether the unit is old or new products is made on the basis of the determination on whether the electronic element (new product detection element) is destroyed.

On the other hand, when there is a problem in an image formed by the image forming apparatus, it is necessary to determine whether the problem is caused by the apparatus main body or the unit. For this purpose, there is a case where a user or the like mounts a new unit for a test in the main body of the image forming apparatus in which a problem arises and checks the operation of the unit. In this case, in the apparatus as described in Japanese Unexamined Patent Application Publication No. 6-118736, if a new unit is mounted, this unit is determined as new, and a new product detection element, such as a fuse or the like, is destroyed (fused). Thereafter, an image is output to carry out operation check.

For this reason, in this case, when a problem is caused by the apparatus main body, a unit (new unit) which has not problem is replaced, and the unit which has no problem is wasted. Thus, a configuration in which the new product detection element is fused after a predetermined value (a number of counts of image formation) is reached, not just after a new unit is mounted, is known (Japanese Unexamined Patent Application Publication No. 2006-145765). That is, Japanese Unexamined Patent Application Publication No. 2006-145765 describes a technique in which fusing is not made until a number of sheets on which images are formed reaches a predetermined number of sheets, and a new unit is recognized as new even when the new unit is used in another apparatus after the new unit has been used for a test.

If a new product detection element is fused, a counter which is provided in an apparatus main body is set to "0", and determination of the lifetime of a unit can be made on the basis of the counter (Japanese Patent No. 3132073).

An image forming apparatus is also known which includes a toner density detection unit detecting a toner density, an operation detection unit detecting a history on whether a toner cartridge is in an initial state in which the toner cartridge has not been operated or in a state in which the toner cartridge has been operated, and a memory storing data on the history detected by the operation detection unit (Japanese Unexamined Patent Application Publication No. 9-185236). In this case, when a new toner cartridge which has not been operated is loaded, the history data is initialized, and an image forming operation is carried out under operation conditions set in advance. That is, in this image forming apparatus, a number image formation and related processing are performed in the image forming operation, in order to achieve stable image quality.

On the other hand, as described above, an image forming apparatus includes a plurality of types of units, and the units are different in expiration date. For this reason, it is preferable that the units are replaceable separately.

However, in a conventional image forming apparatus as described above, an image carrier unit and a toner supply unit are integrated as a single process cartridge, and are not replaceable separately. When the units are replaceable separately, a detection unit should be provided in each unit to detect whether the unit is new or not. For example, when an electronic component, such as a fuse, is used for the detection unit, the fuse should be provided in each unit, and an electric circuit should be provided so as to supply power to the fuse. For this reason, there is a limitation on making the entire apparatus compact.

SUMMARY OF THE INVENTION

It is an object of the present invention to at least partially solve the problems in the conventional technology.

According to an aspect of the present invention, there is provided a process cartridge including an image carrier unit which is equipped with an image carrier, on which an electrostatic latent image is formed. The image carrier unit is configured to be attachable and detachable with respect to an apparatus main body in which the image carrier unit is accommodated. An electrical contact portion is provided in the image carrier unit to form electrical connection between the image carrier unit and another member of the process cartridge in a mounted state in the apparatus main body.

According to another aspect of the present invention, there is provided A process cartridge including a developer supply unit which supplies developer to a member to be supplied with the developer. The developer supply unit is configured to be attachable and detachable with respect to an apparatus main body in which the developer supply unit is accommodated. An electrical contact portion is provided in the developer supply unit to form electrical connection between the developer supply unit and another member of the process cartridge in a mounted state in the apparatus main body.

According to still another aspect of the present invention, there is provided a process cartridge including: an image carrier unit which is equipped with an image carrier, on which an electrostatic latent image is formed; and a developer supply unit which supplies developer to the image carrier unit that is a member to be supplied with the developer. The image carrier unit and the developer supply unit are configured to be attachable and detachable with respect to an apparatus main body in which the image carrier unit and the developer supply unit are accommodated. Electrical contact portions are provided to form electrical connection between the image carrier unit and the developer supply unit in a mounted state in the apparatus main body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of the invention will be described with reference to the drawings.

Figure 1:
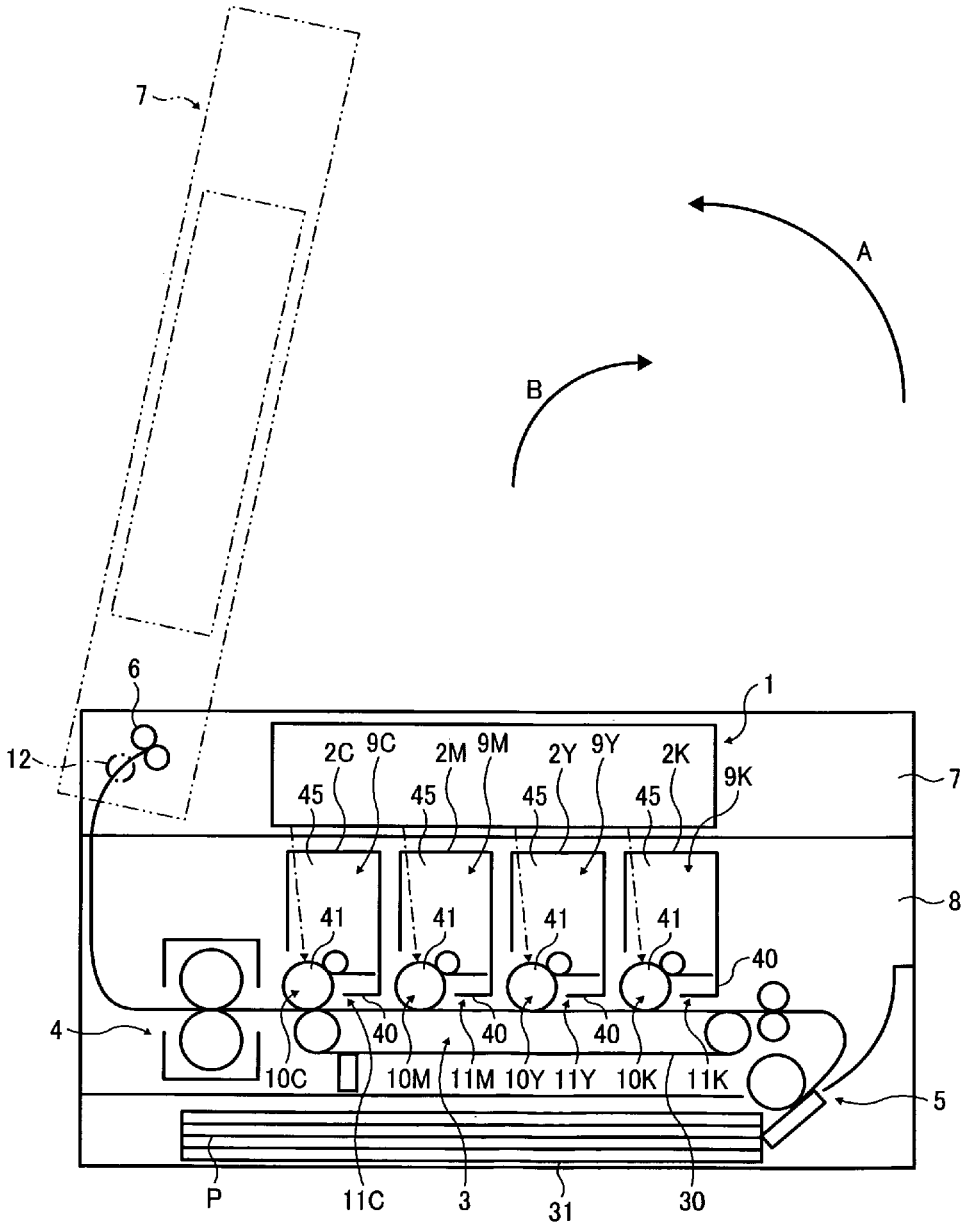
FIG. 1 is an overall schematic view of an electrophotographic apparatus according to the invention.
Figure 2:
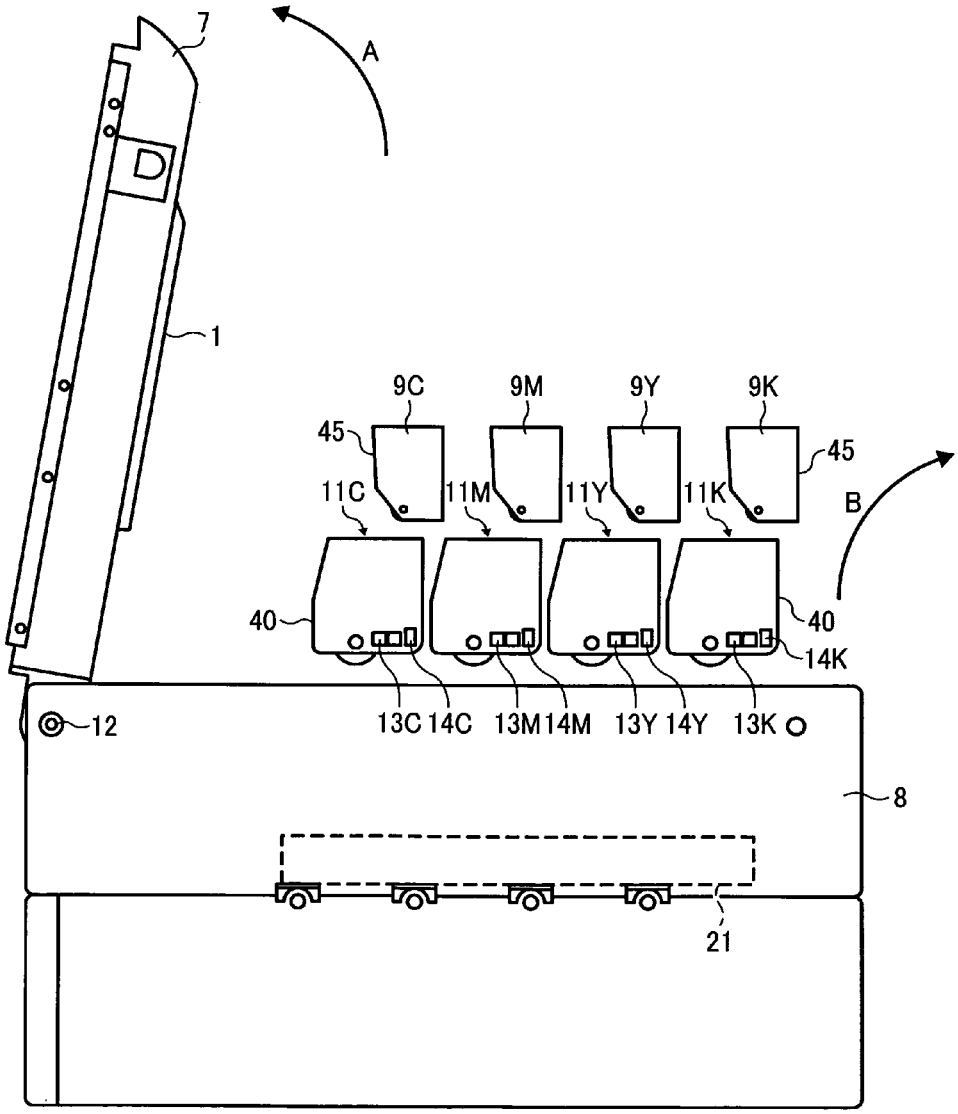
FIG. 2 is a schematic view showing a state where an image carrier unit and a developer supply unit are disassembled.
Figure 3:
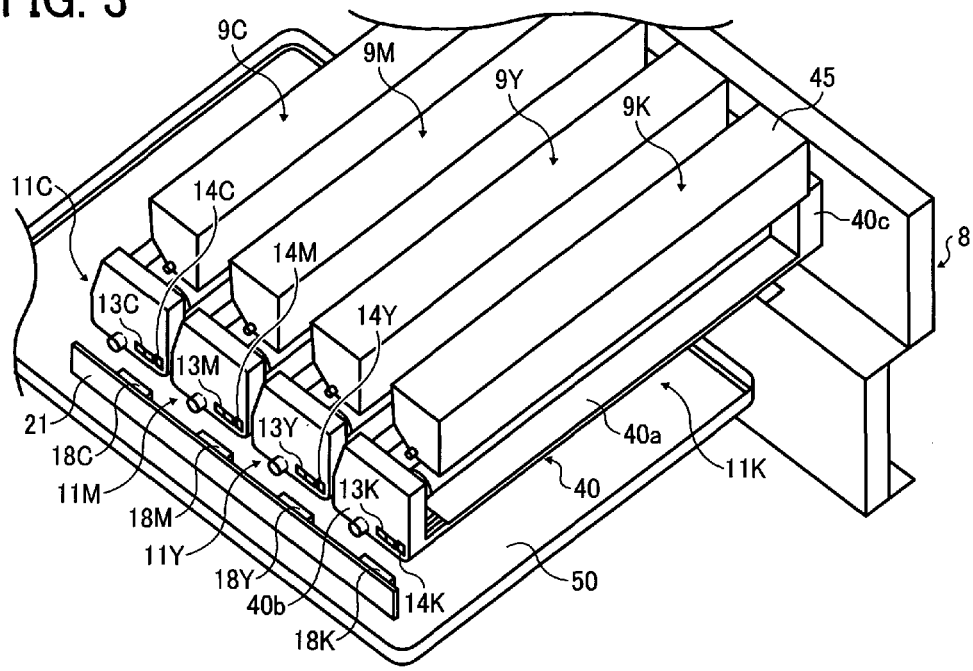
FIG. 3 is a schematic perspective view of the image carrier unit and the developer supply unit.

FIG. 1 is a schematic sectional view of a laser printer which is an example of an electrophotographic apparatus according to the invention. This apparatus includes an upper structure 7 and a lower structure 8. The upper structure 7 is equipped with a writing unit 1, and pivots around a turning fulcrum 12 provided in the lower structure 8 in a direction indicated by an arrow A to be in an open state. The lower structure 8 is equipped with a process cartridge 2 (2C, 2M, 2Y, or 2K), a transfer unit 3, a fixing unit 4, a sheet feeder 5, and the like. As shown in FIGS. 2 and 3, the process cartridge 2 includes an image carrier unit 11 and a developer supply unit 9. The image carrier unit 11 is equipped with at least a photosensitive drum constituting an image carrier 10, and the developer supply unit 9 is configured to supply toner serving as developer to the image carrier unit 11.

A transfer belt 30 is provided below the process cartridge 2, and a sheet feed cassette 31 in which recording mediums P are stacked/accommodated is arranged below the transfer belt 30. A recording medium P fed by the sheet feeder 5 passes through the transfer belt 30 and is guided to the fixing unit (fixer) 4, and a toner image is thermally fixed to the recording medium P. That is, laser light irradiated by the writing unit 1 is incident on the uniformly charged image carrier 10 to form an electrostatic latent image on the image carrier 10, and the electrostatic latent image is developed with developer (toner) supplied from the developer supply unit 9. The recording medium P is guided from the sheet feed cassette 31 into the apparatus, and the toner image formed on the image carrier 10 is transferred on the recording medium P by the transfer unit 3 and fixed on the recording medium P by the fixing unit 4. Thereafter, the recording medium P is discharged from a sheet discharge unit 6 outside the apparatus.

For this reason, in the electrophotographic apparatus, the image carrier unit 11 equipped with the image carrier 10 is arranged above the transfer unit 3, and the developer supply unit 9 is arranged above the image carrier unit 11.

The image carrier unit 11 includes a casing 40, a photosensitive drum 41 which constitutes the image carrier 10, which is accommodated in the casing 40, an image carrier driving gear 42 (see FIG. 4) which is arranged in the axial end portion of the photosensitive drum 41, and the like. As shown in FIG. 3, the casing 40 includes a main body portion 40*a* in which the photosensitive drum 41 is accommodated, and end wall portions 40*b* and 40*c* which are arranged in the end portions of the main body portion 40*a* in the axial direction.

Figure 4:
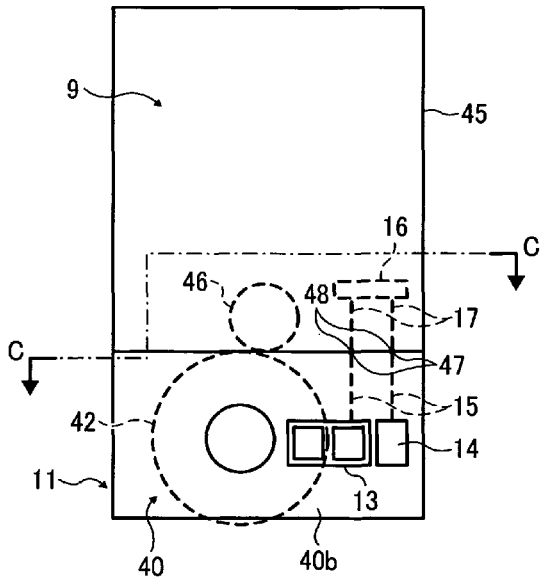
FIG. 4 is a schematic front view of a process cartridge including the image carrier unit and the developer supply unit.

As shown in FIG. 4, the developer supply unit 9 includes a casing 45, a developer stirring member which is accommodated in the casing 45, and a developer supply unit gear 46 which is connected to the developer stirring member. As shown in FIG. 3, the developer supply unit 9 is assembled with the image carrier unit 11 in a state of being interposed between the end wall portions 40*b* and 40*c* of the image carrier unit 11.

In a state where the developer supply unit 9 and the image carrier unit 11 are assembled, the image carrier driving gear 42 and the developer supply unit gear 46 are meshed with each other. For this reason, if driving force is transmitted to the image carrier driving gear 42, the developer supply unit gear 46 which is meshed with the image carrier driving gear 42 is driven to rotate. That is, the image carrier driving gear 42 and the developer supply unit gear 46 are driven simultaneously.

Figure 5:
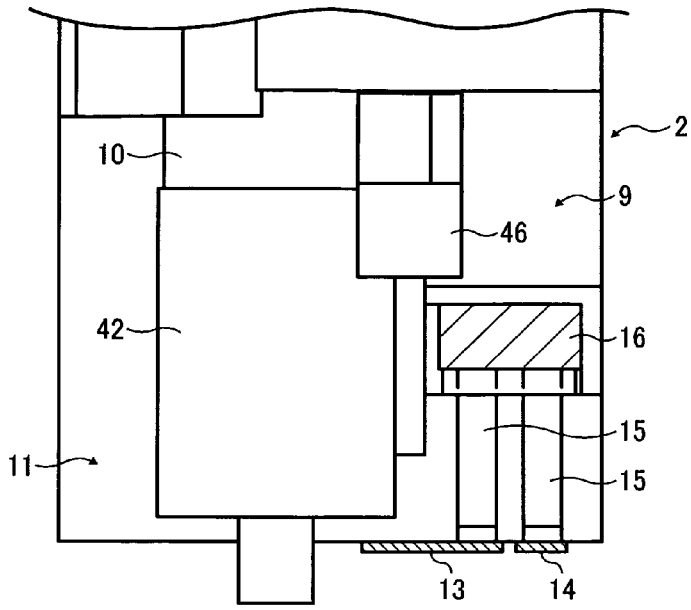
FIG. 5 is a sectional view taken along a line C-C of FIG. 4.

On the other hand, an electrical contact portion (image carrier unit contact) 14 and a new product detection element 13 are provided on an outer surface of the end wall portion 40*b* of the image carrier unit 11. As shown in FIGS. 4 and 5, in the main body portion of the image carrier unit 11, a contact portion 47 connected to the contact portion 14 through a contact member (metallic thin flat plate) which is buried in the end wall portion 40*b* is provided.

A new product detection element 16 is arranged in the developer supply unit 9, and a contact member 17 extends from the new product detection element 16. The contact member 17 is provided with a contact portion 48 which is exposed from a lower surface of the casing 45 of the developer supply unit 9.

For this reason, in a state where the developer supply unit 9 and the image carrier unit 11 are assembled, the contact portion 47 on the image carrier unit 11 side is connected to the contact portion 48 on the developer supply unit 9 side.

Figure 6:
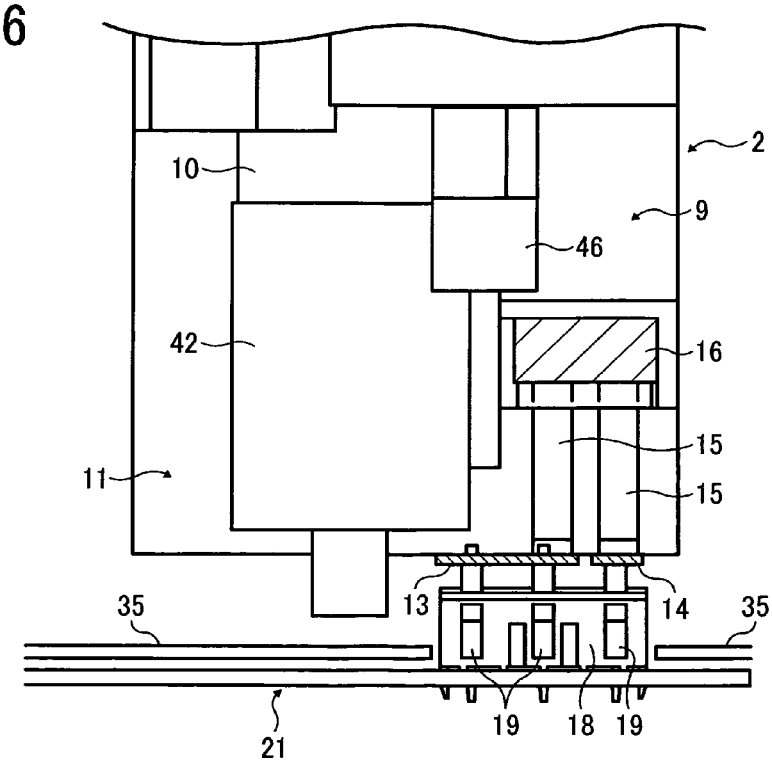
FIG. 6 is a sectional plan view of a state where a process cartridge is mounted in an apparatus main body.
Figure 7A:
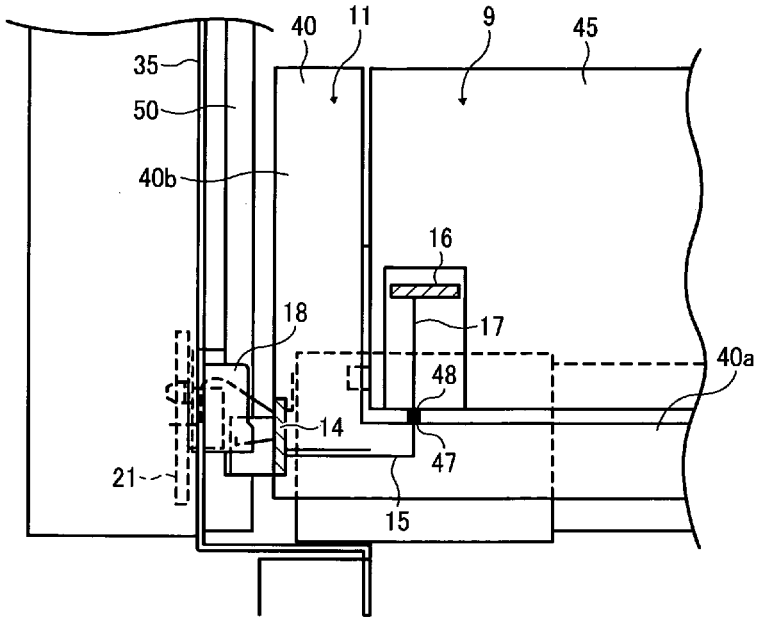
FIGS. 7A and 7B show an assembled state of a process cartridge, FIG. 7A being a schematic plan view and FIG. 7B being a schematic perspective view.

On the other hand, when the process cartridge 2 configured as above is accommodated in the lower structure 8, as shown in FIGS. 6 and 7A, the contact portion 14 provided in the image carrier unit 11 is connected to a contact portion 19 on the apparatus main body side, that is, on the lower structure 8 side. The contact portion 19 on the lower structure 8 side is arranged in a contact array substrate 21 which is provided in a base receiving the process cartridge 2. That is, a plurality of contact portions 19 are formed in the contact array substrate 21 to constitute a main body-side contact array 18.

Therefore, the contact portion 14 provided in the image carrier unit 11 is connected to the contact portion 19 provided in the lower structure 8, and power is supplied from the main body-side contact portion 19 to the contact portion 14 on the image carrier unit 11 side. An electrical signal input to the contact portion 14 flows to the contact member 17 on the developer supply unit 9 side through a contact member 15 and applied to the new product detection element 16 on the developer supply unit 9 side. The new product detection element 13 of the image carrier unit 11 is provided at a part of the contact portion 14 on the image carrier unit 11. When power is supplied to the contact portion 14 on the image carrier unit 11 side, an electrical signal is also applied to the new product detection element 13.

On the other hand, the new product detection elements 13 and 16 may be constituted by a fuse or a diode, which is inexpensive, has simple structure, and is small. In this case, the new product detection element 13 and the new product detection element 16 are constituted by elements having the same structure. In a method of determining whether a unit is new or old using a new product detection element, such as a fuse or a diode, for example, the conduction state of the new product detection element of each of the units 9 and 11 mounted in the apparatus main body is detected to determine whether the unit is new or old, and when the unit is determined as new, predetermined initialization processing is performed and the new product detection element, such as a fuse, is fused (cut).

For this purpose, it is necessary to provide to the apparatus main body with a new and old unit identification unit which detects whether or not a current flows through the new product detection element, a fusing unit which supplies an overcurrent to the new product detection element, etc. However, these circuits are comparatively simple circuits, thereby achieving low cost.

In the electrophotographic apparatus, if a fuse or a diode serving as a new product detection element is fused (cut), a counter value of a counter provided in the apparatus main body is initialized. The value is updated in accordance with the used amount, and when the service limit is reached, this state is notified to a user or the like.

Figure 7B:
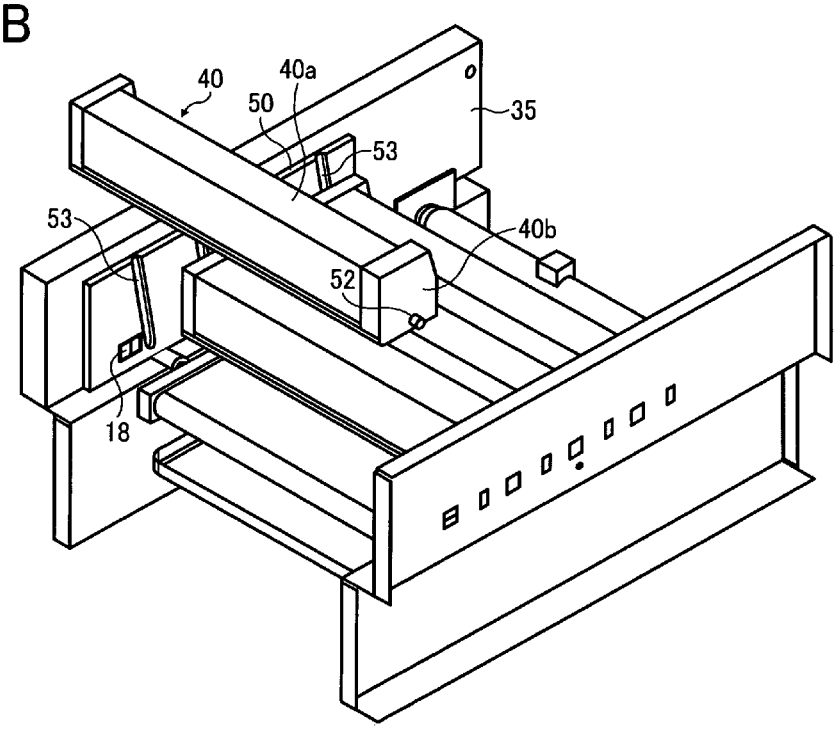

On the other hand, the process cartridge 2 is mounted on a support base portion 50 arranged in a side wall portion 35 of the lower structure 8. The contact array substrate 21 is arranged in the side wall portion 35. For this reason, as indicated by a virtual line of FIG. 1, when the upper structure 7 is in the open state, the process cartridge 2 can be removed and accommodated (mounted). In this case, engagement protrusions 52 (see FIG. 9) are provided in the end wall portions 40*b* and 40*c* of the casing, and the engagement protrusions 52 are engaged with grooves 53 (see FIG. 7B) of the support base portion 50. That is, in mounting the process cartridge 2, the engagement protrusions 52 of the casing 40 are inserted into the opposing grooves 53 of the support base portion 50 from above.

In removing the process cartridge 2, as indicated by a virtual line of FIG. 1, the upper structure 7 is caused to be in the open state, and in this state, the process cartridge 2 which is constituted by the developer supply unit 9 and the image carrier unit 11 can be drawn out upward (obliquely upward) and removed. Alternatively, the developer supply unit 9 can be removed from the apparatus main body by upwardly lifting only the developer supply unit 9 while causing the image carrier unit 11 to remain in the apparatus main body. Further, the image carrier unit 11 can be removed from the apparatus main body by upwardly lifting the image carrier unit 11 after the developer supply unit 9 is removed.

In accommodating the process cartridge 2, as indicated by a virtual line of FIG. 1, the upper structure 7 is caused to be in the open state, and in this state, the process cartridge 2 which is constituted by the developer supply unit 9 and the image carrier unit 11 can be mounted in the support base portion 50 from above. In this case, after only the image carrier unit 11 of the process cartridge 2 is first mounted in the open state, the image carrier unit 11 can be mounted on the developer supply unit 9.

According to the process cartridge of the invention, because it becomes possible to supply power to the image carrier unit 11 and the developer supply unit 9 by causing the process cartridge in a state where the process cartridge is mounted in the apparatus main body, an electrical connection circuit between the image carrier unit 11 and the developer supply unit 9 can be simplified.

One of the image carrier unit 11 and the developer supply unit 9 may be electrically connected to the apparatus main body in which the units 11 and 9 are accommodated, so that it is not necessary to provide, to another of the image carrier unit 11 and the developer supply unit 9, a contact portion (connection terminal) for electrical connection to the apparatus main body. For this reason, it is possible to achieve compactness of the process cartridge 2.

On the other hand, in the electrophotographic apparatus of the invention, the process cartridge 2 itself can be replaced and only the developer supply unit 9 which is arranged above the image carrier unit 11 can be replaced. That is, it is possible to achieve ease of replacement of the developer supply unit 9 which early reaches the service limit, and thus to achieve excellent handling property. When a contact portion to the main body side is provided in the image carrier unit 11, it is not necessary to provide a contact portion to the main body in the developer supply unit 9 which is frequently replaced, and thus damage of the contact portion to the main body side or the like does not occur at the time of replacement of the developer supply unit 9.

Since the new product detection elements 13 and 16 are provided, it is possible to determine whether a unit is new or not, and even when a unit which is not new is mounted again, there is no case where the unit is erroneously determined as new.

If the new product detection element 13 on the image carrier unit 11 side and the new product detection element 16 on the developer supply unit 9 side are components having the same structure, it is possible to achieve reduction in the number of types of components, making it possible to reduce in cost. Further, this allows portions, to which the new product detection elements 13 and 16 are respectively attached, to be formed in the same shape and thus manufacturability and simplification of the configuration can be achieved.

When a driving force can be transmitted between the image carrier unit 11 and the developer supply unit 9, a driving source in one of the units can be omitted, making it possible to achieve compactness of the apparatus and low cost.

On the other hand, taking into consideration only the image carrier unit 11, in a state where the image carrier unit 11 is mounted in the apparatus main body, it becomes possible to supply power to the image carrier unit 11. Thus, an electrical operation of the image carrier unit 11 becomes possible, the function of the image carrier unit 11 can be effectively exhibited, and an electrical connection circuit can be simplified.

Taking into consideration only the developer supply unit 9, in a state where the developer supply unit 9 is mounted in the apparatus main body, it becomes possible to supply power to the developer supply unit 9. Thus, an electrical operation of the developer supply unit 9 becomes possible, the function of the developer supply unit 9 can be effectively exhibited, and an electrical connection circuit can be simplified.

Taking into consideration only the combination of the image carrier unit 11 and the developer supply unit 9, in a state where the image carrier unit 11 and the developer supply unit 9 are mounted in the apparatus main body, it becomes possible to supply power to the image carrier unit 11 and the developer supply unit 9. Thus, an electrical connection circuit between the image carrier unit 11 and the developer supply unit 9 can be simplified.

In the above-described embodiment, the developer supply unit 9 is equipped with the new product detection element 16, the contact member 17 is connected to the new product detection element 16, and the contact member 17 is exposed outside the casing 45 of the unit 9. Meanwhile, in FIG. 8, a concave portion 55 is provided in the casing 45 of the developer supply unit 9, and a convex portion 56 is provided in the casing 40 of the image carrier unit 11. In combining the developer supply unit 9 and the image carrier unit 11, the convex portion 56 of the image carrier unit 11 is fitted into the concave portion 55 of the developer supply unit 9.

The new product detection element 16 is provided in the concave portion 55 of the casing 45 of the developer supply unit 9, and an urging member 57 is provided in the convex portion 56 of the casing 40 of the image carrier unit 11 to elastically press an electrical contact portion against an electrical contact portion (in this case, the new product detection element 16) of the developer supply unit 9.

As described above, when the concave portion 55 is provided in the casing 45 of the developer supply unit 9, and the new product detection element 16 is provided in the concave portion 55, it is possible to prevent a worker or the like from touching the new product detection element 16 when replacing the developer supply unit 9 and to prevent sebum of the worker or the like from being stuck to the new product detection element 16, making it possible to suppress occurrence of defective conduction. For this purpose, it is preferable that the concave portion 55 is provided in the lower surface of the developer supply unit 9.

In the configuration in which the convex portion 56 of the image carrier unit 11 is fitted into the concave portion 55 of the developer supply unit 9, the connection state of the image carrier unit 11 and the developer supply unit 9 can be stabilized, so that the functions of the units 11 and 9 can be effectively exhibited.

When the urging member 57 is provided, the electrical contact portions are stably in contact with each other. This contact is elastic, making it possible to prevent damage of the contacted portions from or the like and to achieve excellent durability. The urging member 57 is not provided on the developer supply unit 9 side, which allows an amount of developer of the developer supply unit 9 to be large.

Figure 8:
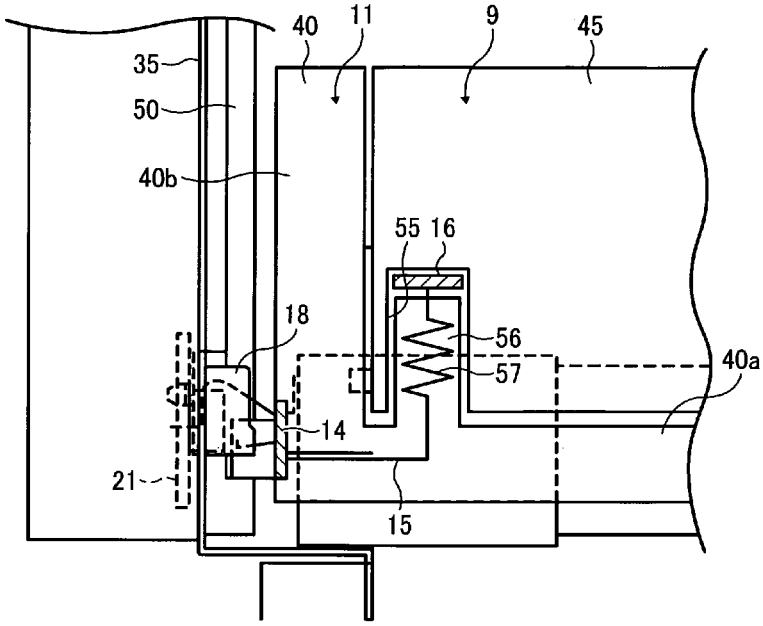
FIG. 8 is a schematic view of a main part of a process cartridge according to another embodiment.
Figure 9:
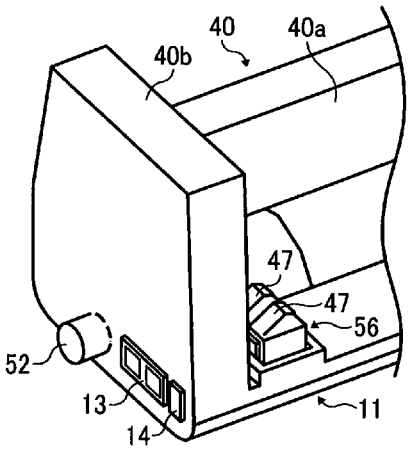
FIG. 9 is a schematic perspective view of a main part of an image carrier unit in a process cartridge according to a modification.
Figure 10:
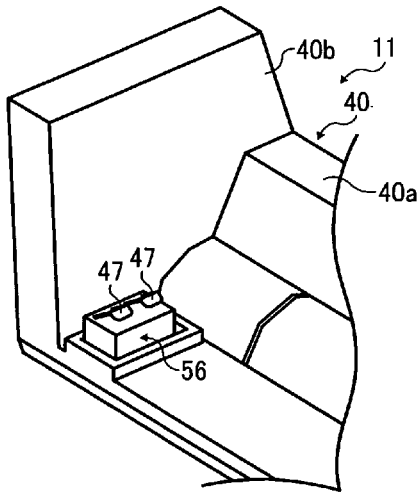
FIG. 10 is a schematic perspective view when the image carrier unit is viewed from a different direction.

Although, in FIG. 8, the urging member 57 is constituted by a coil spring in the convex portion 56, as shown in FIGS. 9 and 10, the contacted portion 47 itself may be configured to serve as a plate spring. In this case, a plate material (sheet-metal material) may be used which connects the contact portion 14, the contact member 15, and the contacted portion 47 serving as the plate spring.

Figure 11:
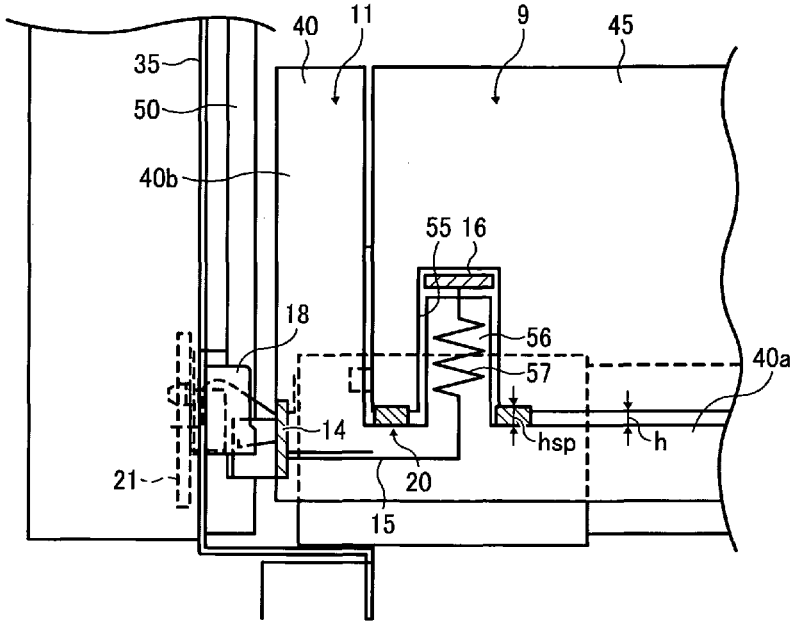
FIG. 11 is a schematic view of a main part of a process cartridge according to another embodiment.

In FIG. 11, a seal member 20 is provided to seal the contact portion between the image carrier unit 11 and the developer supply unit 9. When the concave portion 55 is a circular hole and the convex portion 56 has a columnar shape, the seal member 20 is constituted by a ring having a flattened rectangular shape in section. Although, as the material for the seal member, various materials, such as elastic rubber and resin, may be used, a material which can cope with the usage environment (usage atmosphere) of the apparatus can be used. With regard to the situation that the material can cope with the usage environment (usage atmosphere), it should suffice that no deterioration occurs even when the material is used in such an atmosphere, and predetermined elasticity can be exhibited. In this example, sponge is used.

When the thickness (height) of the seal member 20 in the free state (at the time of no load) is hsp, and the gap between the image carrier unit 11 and the developer supply unit 9 in a state where the image carrier unit 11 and the developer supply unit 9 are assembled is h, the relationship hsp>h is established.

For this reason, in a state where the image carrier unit 11 and the developer supply unit 9 are assembled, the seal member 20 is slightly compressed to seal the contact portion. In this way, the seal member 20 is provided, so that a foreign substance (developer, dust, or the like) does not enter the contact portion, making it possible to prevent occurrence of defective conduction due to the foreign substance.

Figure 12:
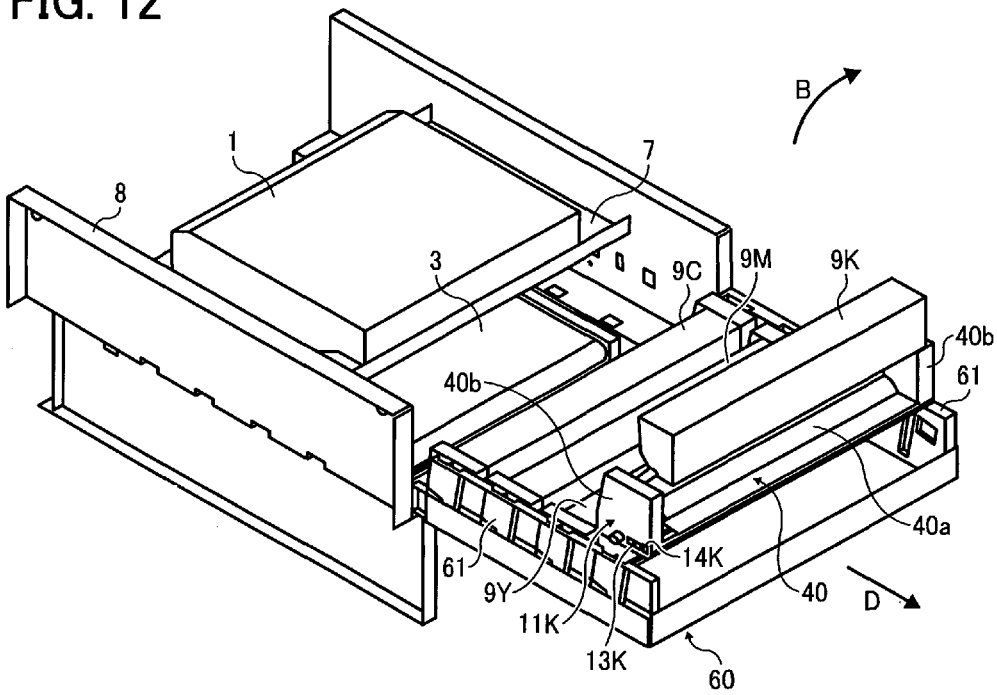
FIG. 12 is a schematic view of a main part of another electrophotographic apparatus according to the invention.

FIG. 12 shows another electrophotographic apparatus. In this electrophotographic apparatus, the lower structure 8 is fixed to the upper structure 7, and the writing unit 1 is attached to the upper structure 7. The lower structure 8 is provided with a drawer portion 60 which is drawn out in a direction indicated by an arrow D along the horizontal direction, and the process cartridge 2 is arranged in the drawer portion 60. Also in this case, as in the above-described example, the process cartridge 2 is configured by combining the image carrier unit 11 and the developer supply unit 9 which can be separated from each other.

In this case, the drawer portion 60 is provided with upright walls 61 at both ends in a direction perpendicular to the drawn-out direction, and the process cartridge 2 is arranged between the upright walls 61.

For this reason, in the electrophotographic apparatus of FIG. 12, when the drawer portion 60 is drawn out as indicated by the arrow D from the state where the process cartridge 2 is accommodated, the process cartridge 2 can be removed from the apparatus main body. That is, the developer supply unit 9 can be removed upward with respect to the image carrier unit 11, and the image carrier unit 11 can be removed upward with respect to the drawer portion 60.

In accommodating the process cartridge 2, in a state where the drawer portion 60 is drawn out from the apparatus main body, the process cartridge 2 is mounted in the drawer portion 60 from above. After the process cartridge 2 is mounted in the drawer portion 60, the drawer portion 60 is slid in the opposite direction to the direction indicated by the arrow D along the horizontal direction. With regard to the process cartridge 2, first, a configuration may be employed in which the image carrier unit 11 is mounted in the drawer portion 60 and then the developer supply unit 9 is mounted on the image carrier unit 11, or a configuration may be employed in which the image carrier unit 11 and the developer supply unit 9 are assembled and locked to form the process cartridge 2, and then the process cartridge 2 is mounted in the drawer portion 60.

For this reason, in the electrophotographic apparatus of FIG. 12, the process cartridge 2 has the same configuration as the process cartridge 2 in the electrophotographic apparatus of FIG. 1, so that the same advantages as the process cartridge 2 in the electrophotographic apparatus of FIG. 1 can be obtained.

The invention is not limited to the foregoing examples, and various modifications can be made without departing from the spirit and scope of the invention. The image forming apparatus of the invention includes an electrophotographic copying machine, a laser beam printer, and a facsimile machine. When the concave portion 55 is provided on the developer supply unit 9 side, the size and shape of the concave portion 55 may be changed in various ways as long as it is possible to prevent the user from touching the contact portion 48 which is formed in the concave portion 55 at the time of replacement or the like, and to ensure that a sufficient amount of developer can be stored. For this reason, the size and shape, and the like of each of the convex portion 56 which is provided to correspond to the concave portion 55 in the image carrier unit 11, the seal member 20, and the electrical contact portion 47 may be changed in various ways.

According to the present invention, there may be provided a process cartridge of a first aspect, which includes an image carrier unit which is equipped with an image carrier, on which an electrostatic latent image is formed. The image carrier unit is configured to be attachable and detachable with respect to an apparatus main body in which the image carrier unit is accommodated. An electrical contact portion is provided in the image carrier unit to form electrical connection between the image carrier unit and another member of the process cartridge in a mounted state in the apparatus main body.

With the process cartridge of the first aspect, the image carrier unit is attachable and detachable with respect to the apparatus main body, thus the image carrier unit is replaceable. Because the electrical contact portion is provided, it becomes possible to supply power to the image carrier unit when the process cartridge is mounted in the apparatus main body. Therefore, the electrical operation of the image carrier unit becomes possible, the function of the image carrier unit can be effectively exhibited, and an electrical connection circuit can be simplified.

According to the present invention, there may be provided a process cartridge of a second aspect, which includes a developer supply unit which supplies developer to a member to be supplied with the developer. The developer supply unit is configured to be attachable and detachable with respect to an apparatus main body in which the developer supply unit is accommodated. An electrical contact portion is provided in the developer supply unit to form electrical connection between the developer supply unit and another member of the process cartridge in a mounted state in the apparatus main body.

With the process cartridge of the second aspect, the developer supply unit is attachable and detachable with respect to the apparatus main body, thus the developer supply unit is replaceable. Because the electrical contact portion is provided, it becomes possible to supply power to the developer supply unit when the process cartridge is mounted in the apparatus main body. Therefore, the electrical operation of the developer supply unit becomes possible, the function of the developer supply unit can be effectively exhibited, and an electrical connection circuit can be simplified.

According to the present invention, there may be provided a process cartridge of a third aspect, which includes an image carrier unit which is equipped with an image carrier, on which an electrostatic latent image is formed; and a developer supply unit which supplies developer to the image carrier unit that is a member to be supplied with the developer. The image carrier unit and the developer supply unit are configured to be attachable and detachable with respect to an apparatus main body in which the image carrier unit and the developer supply unit are accommodated. Electrical contact portions are provided to form electrical connection between the image carrier unit and the developer supply unit in a mounted state in the apparatus main body.

With the process cartridge of the third aspect, the image carrier unit and the developer supply unit is attachable and detachable with respect to the apparatus main body, thus the image carrier unit and the developer supply unit are replaceable. Because the electrical contact portion is provided, it becomes possible to supply power to the image carrier unit and the developer supply unit when the process cartridge is mounted in the apparatus main body.

In the process cartridge of the third aspect, it is preferable that one of the image carrier unit and the developer supply unit is electrically connected to the apparatus main body in which the image carrier unit and the developer supply unit are accommodated. With this setting, it is possible to supply power from the apparatus main body to one of the image carrier unit and the developer supply unit. Further, because the image carrier unit and the developer supply unit are connected to each other through the electrical contact portion, it is possible to supply power from one unit to the other unit. For this reason, it is not necessary to provide a contact portion to be electrically connected to the apparatus main body in the other unit. That is, the ground terminal can be shared, and a number of terminal places and a number of terminals can be reduced, making it possible to achieve compactness and low cost of the process cartridge.

On the other hand, taking into consideration the service limit of the image carrier unit and the developer supply unit, the service limit corresponds to the lifetime of a photosensitive drum constituting the image carrier in the image carrier unit, and corresponds to the residual developer amount in the developer supply unit. For this reason, the developer supply unit reaches the service limit earlier than the image carrier unit.

Therefore, it is preferable that the developer supply unit is arranged above the image carrier unit, the image carrier unit and the developer supply unit are configured to be removed upward from the apparatus main body, and a contact portion to be electrically connected to the apparatus main body is provided in the image carrier unit. That is, according to this, when the image carrier unit and the developer supply unit can be removed upward from the apparatus main body, and the developer supply unit is arranged above the image carrier unit, it is possible to achieve ease of replacement of the developer supply unit which early reaches the service limit. When the contact portion to be electrically connected to the apparatus main body is provided in the image carrier unit, it is not necessary to provide a contact portion to be electrically connected to the apparatus main body in the developer supply unit which is frequently replaced. For this reason, there is no case where damage of the contact portion to be electrically connected to the apparatus main body or the like occurs at the time of replacement of the developer supply unit.

In the electrophotographic apparatus of the invention, reduction in size and low cost can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A process cartridge, comprising:

an image carrier unit which is equipped with an image carrier, on which an electrostatic latent image is formed; and a developer supply unit which supplies developer to the image carrier unit that is a member to be supplied with the developer, wherein the image carrier unit and the developer supply unit are configured to be attachable and detachable with respect to an apparatus main body in which the image carrier unit and the developer supply unit are accommodated, and electrical contact portions are provided to form electrical connection between the image carrier unit and the developer supply unit in a mounted state in the apparatus main body, and wherein a concave portion is provided in a casing of the developer supply unit, and the electrical contact portion of the developer supply unit is provided in the concave portion.

2. The process cartridge according to claim 1, wherein one of the image carrier unit and the developer supply unit is electrically connected to the apparatus main body in which the image carrier unit and the developer supply unit are accommodated.

3. The process cartridge according to claim 1, wherein the developer supply unit is arranged above the image carrier unit, the image carrier unit and the developer supply unit are configured to be removed upward from the apparatus main body, and a contact portion to be electrically connected to the apparatus main body is provided in the image carrier unit.

4. The process cartridge according to claim 1, wherein a convex portion is provided in a casing of the image carrier unit to protrude toward the developer supply unit, an electrical contact portion to the developer supply unit is arranged in the convex portion, and the convex portion is engaged with the concave portion of the developer supply unit in the mounted state.

5. The process cartridge according to claim 1, wherein an urging member is provided in the image carrier unit to elastically press the electrical contact portion of the image carrier unit against the electrical contact portion of the developer supply unit.

6. A process cartridge, comprising:

an image carrier unit which is equipped with an image carrier, on which an electrostatic latent image is formed; and a developer supply unit which supplies developer to the image carrier unit that is a member to be supplied with the developer, wherein the image carrier unit and the developer supply unit are configured to be attachable and detachable with respect to an apparatus main body in which the image carrier unit and the developer supply unit are accommodated, and electrical contact portions are provided to form electrical connection between the image carrier unit and the developer supply unit in a mounted state in the apparatus main body, and wherein a seal member is provided to seal said contact portions between the image carrier unit and the developer supply unit.

* * * * *